US007497421B2

(12) United States Patent
Jager

(10) Patent No.: US 7,497,421 B2
(45) Date of Patent: Mar. 3, 2009

(54) APPARATUS FOR THE GASIFICATION OF LIQUIDS

(75) Inventor: Claudius Jager, Boulder, CO (US)

(73) Assignee: Gummi-Jaeger LLC (DE)

( * ) Notice: Subject to any disclaimer, the term of this patent is extended or adjusted under 35 U.S.C. 154(b) by 534 days.

(21) Appl. No.: 11/347,159

(22) Filed: Feb. 3, 2006

(65) Prior Publication Data

US 2007/0182036 A1 Aug. 9, 2007

(51) Int. Cl.
*B01F 3/04* (2006.01)

(52) U.S. Cl. ..... 261/122.2; 261/124

(58) Field of Classification Search ..... 261/121.1, 261/122.1, 122.2, 124, DIG. 70; 210/220, 210/221.2

See application file for complete search history.

(56) References Cited

U.S. PATENT DOCUMENTS 3,953,555 A * 4/1976 Gley ..... 261/124
6,367,783 B1 * 4/2002 Raftis ..... 261/122.1
6,478,964 B1 * 11/2002 Redmon ..... 210/620
6,619,633 B2 * 9/2003 Jager et al. ..... 261/122.2
6,702,263 B2 * 3/2004 Kelly ..... 261/122.1
6,769,673 B2 * 8/2004 Jager ..... 261/122.2
7,014,176 B2 * 3/2006 Sebastiani et al. ..... 261/122.1
2002/0043729 A1 * 4/2002 Ott ..... 261/122.1
2004/0164433 A1 * 8/2004 Jager ..... 261/122.2

* cited by examiner

*Primary Examiner*—Scott Bushey
(74) *Attorney, Agent, or Firm*—Robert W. Becker; Robert Becker & Associates

(57) ABSTRACT

An apparatus for the gasification or aeration of liquids. Elongated aeration elements are connected to a distribution conduit and have an essentially rigid support tube having a lengthwise rounded groove about which is disposed a membrane of elastomeric material. Compressed gas introduced between the support tube and membrane escapes via slits in the membrane. An elastically deformable flange of a cylindrical portion of a fitting with a plastic semi-rigid saddle portion is disposed between the distribution conduit and one of the aeration elements, and is disposed in a bore in the conduit. The fitting has an essentially flat saddle portion, one side of which rests against the outer surface of the conduit, and the other side of which rests against an end of the aeration element. A hollow bolt is securely connected to the aeration element and is guided through a bore in the fitting into the interior of the conduit, where it is provided with apertures.

22 Claims, 7 Drawing Sheets

APPARATUS FOR THE GASIFICATION OF LIQUIDS

BACKGROUND OF THE INVENTION

The present invention relates to an apparatus for the gasification of liquids, especially for the aeration of water.

Such apparatus are used, for example, in clarification plants. A plurality of aeration elements are disposed on a distribution conduit, whereby the distribution conduit on the one hand serves for the supply of air or gas to the aeration elements, and on the other hand also serves for the securement of the aeration elements. A plurality of distribution conduits can in turn be combined to form a system.

An elongated aeration element is disclosed in DE 33 19 161A1. In addition, DE 36 00 234 discloses an apparatus for the aeration of water, according to which individual aeration elements are connected with the distribution conduit via fittings that during assembly are pressed into a bore in the distribution conduit accompanied by elastic deformation, thereby forming a positive connection. However, the aeration elements are plate-shaped elements. Such a connection is not suitable for elongated aeration elements, which can have an aeration length of up to and greater than one meter. When the apparatus moves or if there are flows in the liquid that is to be aerated, the long aeration elements act like lever arms, so that the forces that occur at the connection locations are much greater than is the case with plate-shaped aeration elements.

It is therefore an object of the present invention, for an apparatus of the aforementioned general type, to provide a connection between aeration element and distribution conduit that is suitable for long aeration elements, and in addition is elastic in order to be able to compensate for movements of the apparatus or flows in the liquid, and that nonetheless is easy to assemble and that requires only a few straightforward components.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
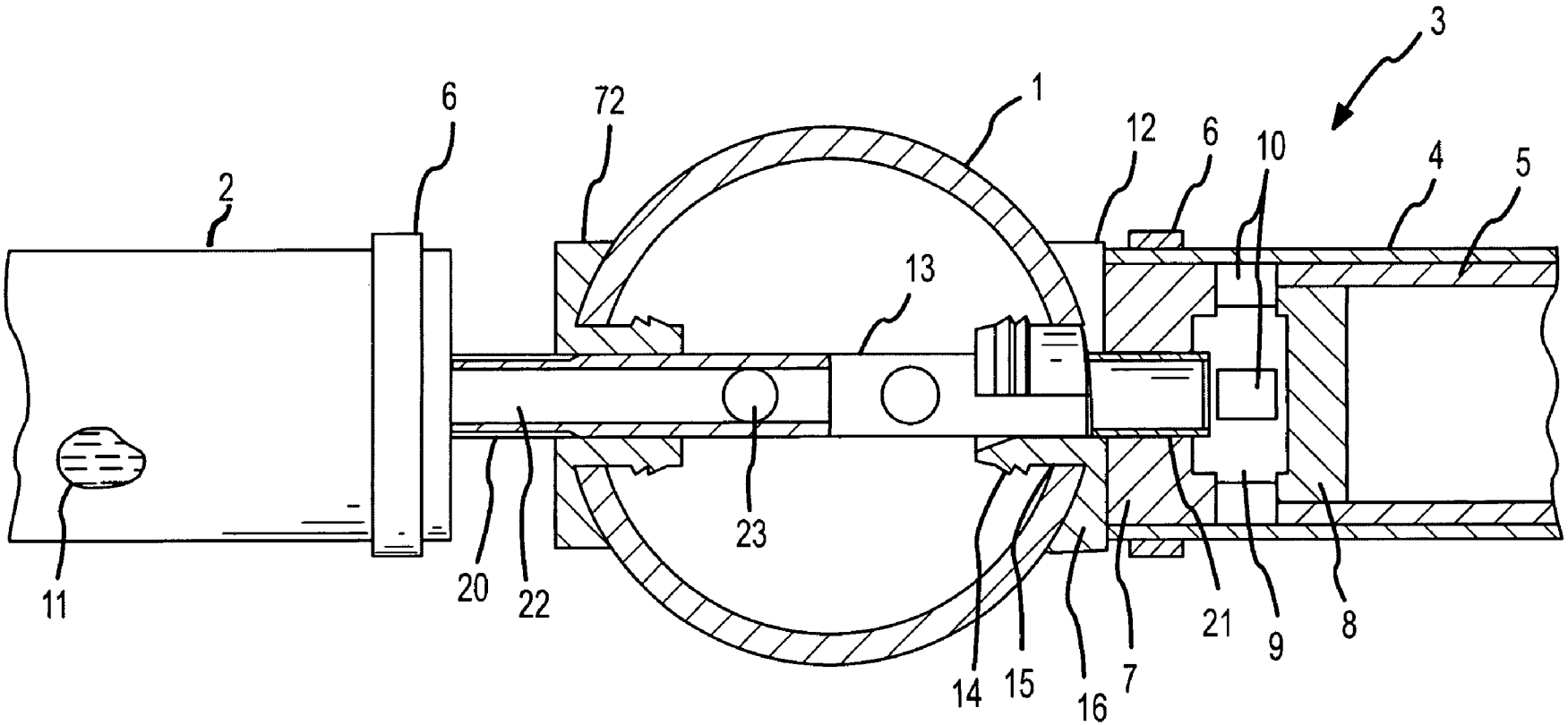
FIG. 1 shows one exemplary embodiment of an inventive apparatus.

The object of the present invention is realized with an apparatus for the gasification or aeration of liquids, especially for the aeration of water, and includes elongated aeration elements that are connected with a distribution conduit that serves for the supply of gas or air, whereby each aeration element has an essentially rigid support tube, optionally, with a rounded groove in its surface, lengthwise, with a membrane of rubber or a rubber-like polymeric material that is disposed on the support tube, and whereby compressed air or gas can be introduced between the support tube with a membrane of rubber or a rubber-like polymeric material that is disposed on the support tube, and whereby compressed air or gas can be introduced between the support tube and the membrane and can escape into the liquid that is to be gasified via slits in the membrane; disposed between the distribution conduit and aeration element is an fitting having optionally a rubber or rubber-like flange on a cylindrical element, and a semi-rigid plastic saddle, whereby the fitting is disposed in a bore that passes through the wall of the distribution conduit, with a fitting having a flat saddle section, one side of which rests against the outer wall of the conduit and the other side of which rests against the end of the aeration element, and whereby a hollow bolt is securely connected fitting and into the interior of the distribution conduit, with the fitting being supported against the distribution conduit and being provided with apertures in its wall on that section thereof that is disposed in the interior of the distribution conduit.

As a consequence of the inventive fitting, an elastic mounting is achieved. The bolt serves not only for the mechanical connection, but also, due to is hollow configuration, for the transport of the air or gas from the distribution conduit to the aeration element. The bolt can be connected with the aeration element by being screwed thereto, whereby pursuant to one advantageous embodiment of the invention, due to an interlocking between aeration undesired loosening or detachment of the screwed connection.

Pursuant to a particularly advantageous embodiment of the invention, aeration elements are respectively disposed in pairs on opposite locations on the distribution conduit, whereby in a given cross-sectional plane, the distribution conduit is provided at two oppositely disposed locations with bores through which a single bolt passes that connects the two aeration elements with one another. In this way, the support of the bolt relative to the wall of the distribution conduit is effected by the respectively other aeration element. The aeration elements thus reciprocally support one another, and the apparatus can make do with a minimum number of parts.

Further specific features of the invention will be described in detail subsequently.

DESCRIPTION OF PREFERRED EMBODIMENTS

Referring now to the drawings in detail, the improved apparatus is provided with a distribution conduit 1 on which are disposed two aeration elements 2 and 3. The right aeration element 3 is shown in section, and the left aeration element 2 is illustrated as being dismounted from the distribution conduit 1. The aeration elements 2, 3 extend perpendicular to the distribution conduit 1. The distribution conduit 1 can be equipped with a plurality of such pairs of aeration elements 2, 3. The construction and manner of operation of the aeration elements 2, 3 will be briefly explained subsequently.

Each of the aeration elements is provided with a support tube 5 of an essentially rigid material, for example a tough polymeric material, on which is disposed a hose-like membrane 4 that elastically surrounds the support tube 5 and in the following is also designated as a sleeve. The sleeve 4 is held by a clamp 6. In the drawing, only a short section of the elongated aeration elements 2 and 3 are shown. A clamp 6 can also be provided at the non-illustrated end of the aeration element for securing the sleeve 4 on the support tube 5.

The end of the aeration element 3 is closed off by a wall 7. The wall 7 can be connected with, or merged into, the support tube 5 in any desired manner. Formed between the wall 7 and a partition or intermediate wall 8 is a chamber 9 that serves for the supply of air to the aeration element 2, 3. In the vicinity of the chamber 9, the wall of the support tube is provided with apertures 10.

The other non-illustrated end of the support tube 5 is open, so that the water or other liquid that surround the apparatus has access to the interior of the support tube 5 up to the partition 8. As a consequence of this manner of construction, during operation only a small portion of the support tube 5 is filled with air, and the buoyancy of the apparatus is therefore low, which is of particular advantage for very long aeration elements 2, 3.

The sleeve 4 is made of an elastic material, especially rubber or a rubber-like polymeric material. Furthermore, the sleeve 4 is provided with a plurality of fine slits, which as can be seen with respect to the aeration element 2 are designated by the reference numeral 11. However, these slits are provided only in that portion of the aeration element 2, 3 that, as viewed from the securement location, is disposed behind or downstream of the partition 8, whereas the sleeve 4 has no slits in the region of the chamber 9.

During operation, compressed air flows from the chamber 9, via the apertures 10, between the support tube 5 and the sleeve 4, and escapes via the slits in the sleeve as fine bubbles into the surround liquid.

The important thing now is the connection of an aeration element 2 or 3 with the distribution conduit 1. A pin or bolt 13 serves for this purpose, and together with a fitting 12 extends through bores 15 in the distribution conduit 1.

Figure 2:
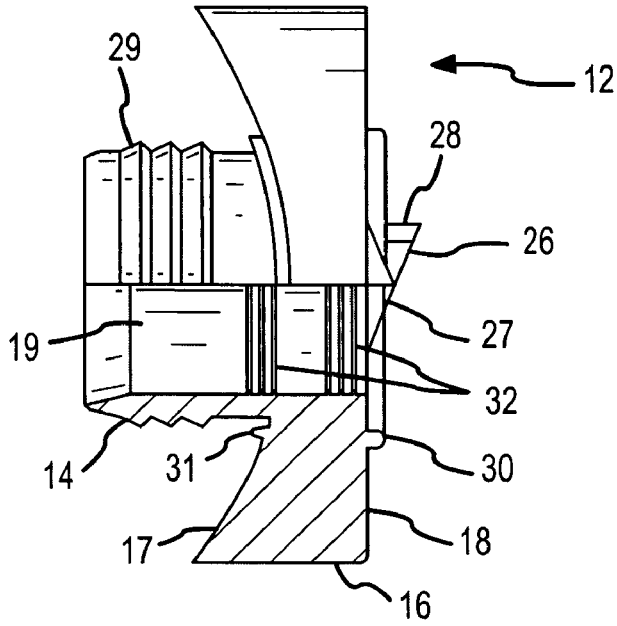
FIG. 2 is a side view of a fitting of the apparatus of FIG. 1.
Figure 3:
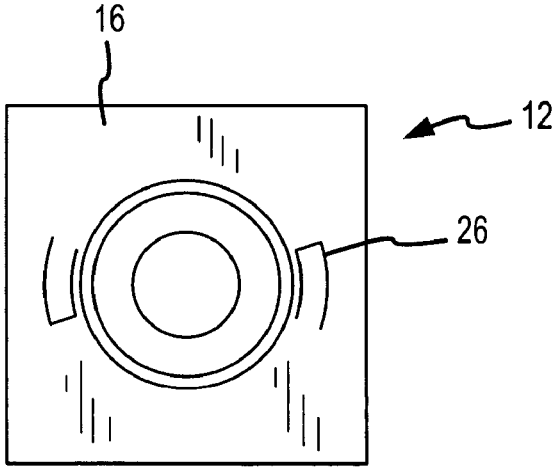
FIG. 3 is a plan view of the fitting of FIG. 2.

As shown in FIG. 2, the fitting 12 has an essentially cylindrical portion 14, and an essentially flat portion 16. The flat portion 16 rests against the outer surface of the distribution conduit 1, whereby it is provided with a concave abutment surface 17 that corresponds to the curvature of the outer surface of the distribution conduit. The opposite outer surface 18 of the fitting 12 rests against the wall 7 at the end of the aeration element 2 or 3.

As depicted in FIGS. 1 and 2, the bolt 13 is guided through a bore 19 in the fitting 12. In the non-installed state, the diameter of the bore 19 is somewhat less than the outer diameter of the bolt 13. As a result, in the assembled state, the fitting 12 acts like a plug or socket, and holds the bolt 13 in the bore 15 of the distribution conduit 1 by a clamping effect. The ends of the bolt 3 are each provided with a thread 20 that serves for a connection with the aeration element 2 or 3. In turn, the aeration elements are provided with corresponding threaded bores 21 in their end wall 7.

In the cross-sectional plane illustrated in FIG. 1, the distribution conduit 1 has two bores 15 that are disposed at positions that are opposite one another on the periphery of the conduit 1. The length of the bolt 13 is such that it extends through both bores 15. The aeration elements 2 and 3 are therefore aligned with one another and reciprocally hold one another in that the bolt 13 is secured against being pulled out in the direction of one of the aeration elements due to the fact that the other aeration element is also screwed on.

The bolt 13 is embodied as a hollow tube. The central portion of the bolt is provided with apertures 23 via which the bore 22 in the interior of the bolt 13 communicates with the distribution conduit 1. By means of the apertures 23, air is guided out of the distribution conduit 1 and via the bore 22 into the chambers 9 of the two aeration elements 2, 3, from where the air eventually passes via the membranes or sleeves 4 into the liquid that is to be gasified. The bolt 13 thus serves not only for the fastening of the aeration elements 2, 3, but also for the supply of air or gas.

Figure 4:
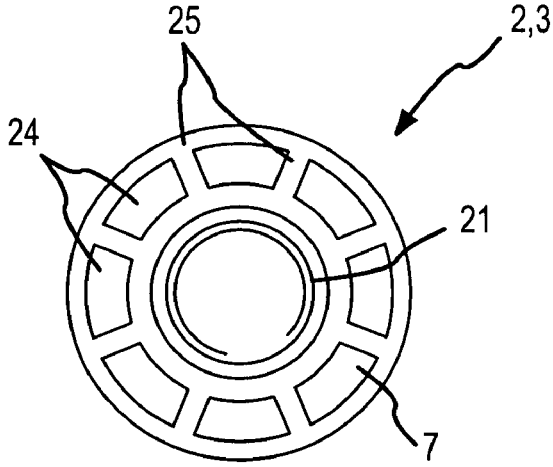
FIG. 4 is an end view of an aeration element of the apparatus of FIG. 1.
Figure 5:
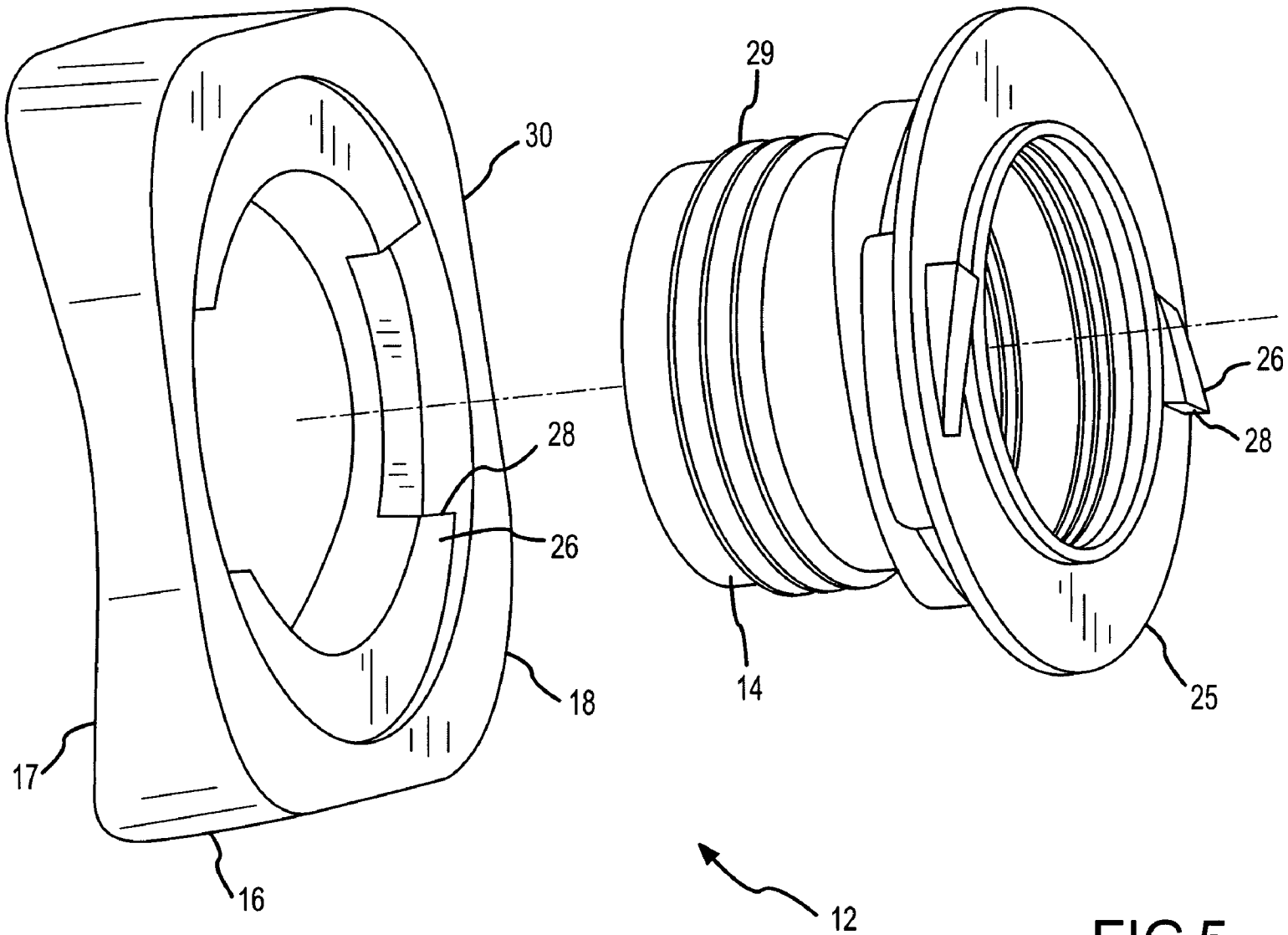
FIG. 5 is a side view of saddle portion and cylindrical portion of fitting of FIGS. 2 and 3, shown disassembled.

The apparatus is equipped with devices that prevent the components of the apparatus from becoming unintentionally detached. For example, each of the end walls 7 of the aeration elements 2 and 3 is provided in the region of its periphery with recessed areas 24 that, as can be seen in FIG. 4, are separated from one another by ribs 25 that extend in a spoke-like manner. That surface 18 of the fitting 12 that faces the aeration element is provided with wedge-shaped projections 26. When an aeration element 2 or 3 is screwed onto the bolt 13, the inclined surfaces 27 of the wedge-shaped projections 26 glide over the ribs 25 and finally engage in the recessed areas 24. The perpendicular surfaces 28 of the projections 26 then prevent an unscrewing, i.e., fitting 12 and the aeration element 2 or 3 are interlocked.

The cylindrical portion 14 of the fitting 12 is provided with ribs 29 that on the side of the free end of the cylindrical portion 14 rise in a flat manner, while on the side of the flat portion 16 of the fitting 12 drop off more steeply. As a consequence of this barbed configuration of the portion 14, the fitting 12 is easy to insert into the bore 15, yet an undesired detachment is prevented.

It is furthermore important that with the apparatus of the present invention, all connection locations are sealed, and in particular not only to prevent unnecessary pressure losses, but also to prevent penetration of dirty water. In order to increase the sealing effect, the outer surfaces 17 and 18 of the flat portion 16 of the fitting 12, as well as in bore 19, are provided with circumferential sealing rings or ridges 30, 31 and 32 that seal these components relative to the aeration elements 2, 3 the distribution conduit 1, and the bolt 13.

The preceding elements of the improved invention are disclosed in U.S. Pat. No. 6,769,673 to Jäger which is incorporated herein by reference. The following elements are improvements on the '673 device and are commonly owned.

A new embodiment of the fitting 12 not only has the inclined surfaces 27 of the wedge-shaped projections 26 which glide over the ribs 25 and finally engage in the recessed areas 24 of aeration elements 2 or 3, but also wedge-shaped projections 26' on the opposing relative surface of the cylindrical opening of flat portion 16 such that the perpendicular surfaces 28' of the projections 26' then prevent an unscrewing between flat portion 16 and essentially cylindrical portion 14, i.e., fitting 12 components, flat portion 16 and essentially cylindrical portion 14 are interlocked. As with the earlier embodiments, the saddle or flat portion 16 then rests against the outer surface of the distribution conduit 1, whereby it is provided with a concave abutment surface 17 that corresponds to the curvature of the outer surface of the distribution conduit. The opposite outer surface 18 of the fitting 12 rests against the wall 7 at the end of the aeration element 2 or 3.

This is an improvement over prior art devices in that the saddle and the cylindrical portion lock themselves into place by expansion against the distribution conduit 1 in the manner of a wall anchor. This process is further aided by utilizing a further alternate embodiment which utilizes a plastic as the flat portion 16 material. This serves to provide a slightly deformable fitting yet provides sufficient rigidity to stabilize the fitting to avoid stress failure and allows for expansion against the distribution conduit 1. Again, improvement in the device can be achieved by allowing the flange 25 of cylindrical portion 14 to be comprised of rubber or a rubber-like plastic or mixture thereof. It improves further over the prior art by allowing additional "sealing" areas to both increase aeration and prevent device failure due to material fatigue. Seals are formed between the saddle and the distribution conduit, including the outside of the pipe and in the opening of the pipe through which the fitting (including the saddle) passes; between the saddle and the aeration element; between the saddle and the cylindrical portion of the fitting.

Figure 6:
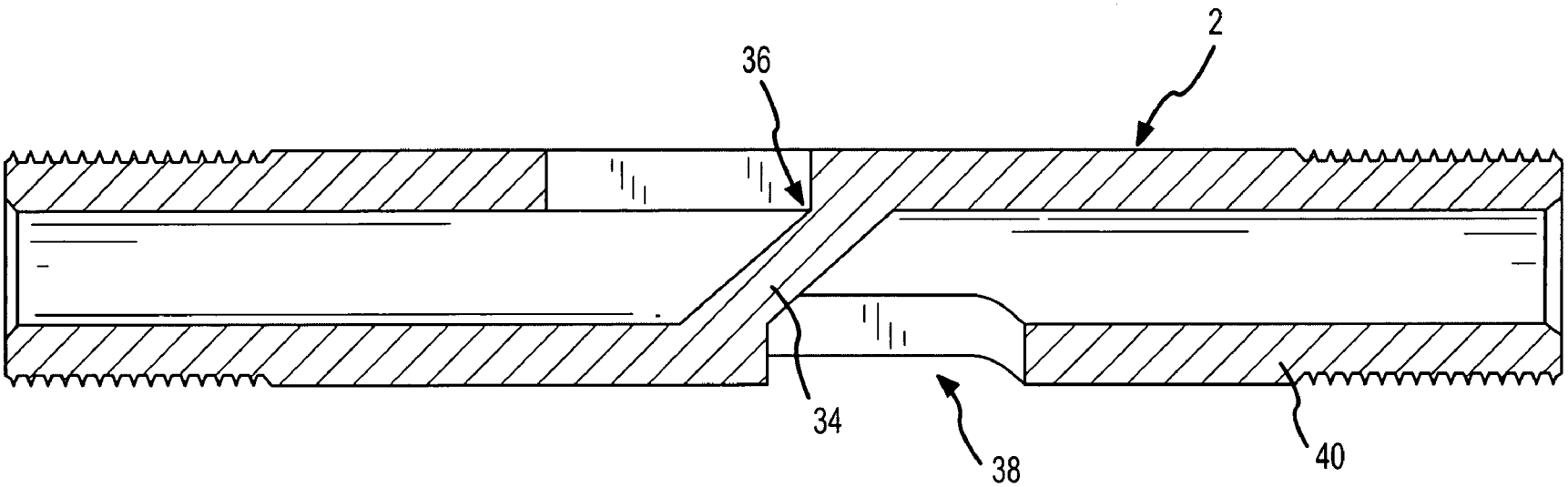
FIG. 6 is a lengthwise cross-section of aeration element of the apparatus of FIG. 1, showing internal ridge and 45° degree deflection angle.

Another improvement on the earlier device can occur with the use an aeration element with a central rib, as shown in FIG. 6. The improved embodiment of the aeration element 2, utilizes a central rib 34 disposed in an approximately central location along the length of long aeration element 2. Central rib 34 allows air flow through the length of tube 2 without much pressure loss given the large air intake cross section 38. Further, there is a guided change of direction of the air flow by an approximately 45° angle 36 of the central rib 34 in relation to the wall 40 of tube 2.

A further improvement in the present invention is use of a "groove tube" embodiment of a tube diffuser aeration element. In present devices, the diffuser area of the sleeve forms an external crease when depressurized. This potentially weakens the sleeve material and can shorten the life expectancy of the sleeve. Surprisingly, the invention utilizing the groove tube can lower the pressure drop of air/gas traveling between the membrane and support tube by approximately 25% which reduces the energy consumption of the system, and can prevent the sleeve forming a crease in the de-pressurized state thereby extending the life expectancy of the unit. As shown in FIG. 1, tube diffuser aeration element 2, sleeve 4 is made of an elastic material, especially rubber or a rubber-like polymeric material. Furthermore, the sleeve 4 is provided with a plurality of fine slits, which as can be seen with respect to the aeration element 2 are designated by the reference numeral 11. However, these slits are provided only in that portion of the aeration element 2, 3 that, as viewed from the securement location, is disposed behind or downstream of the partition 8, whereas the sleeve 4 has no slits in the region of the chamber 9.

Figure 7:
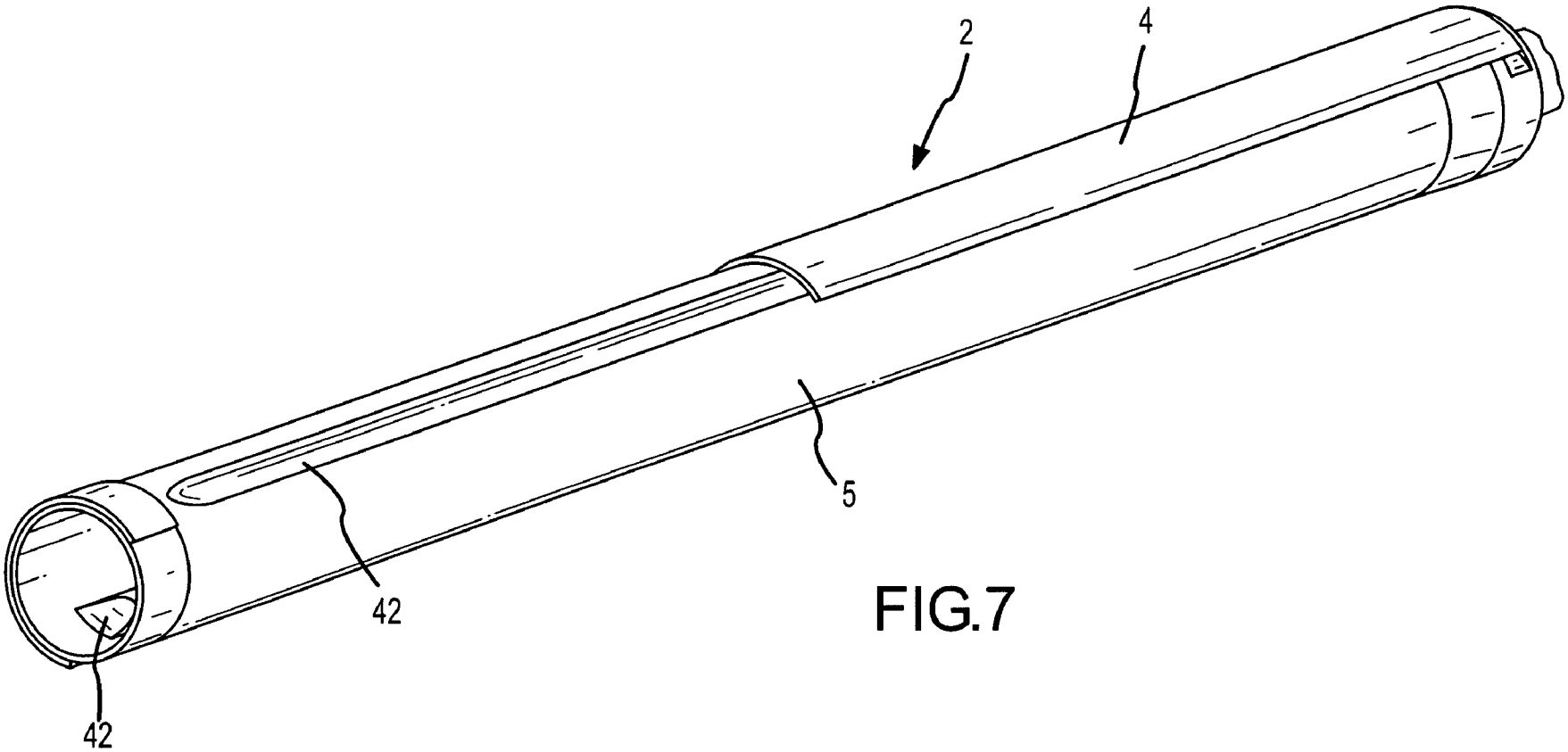
FIG. 7 is a side view of aeration element of the apparatus of FIG. 1, showing rigid support tube and dissected portion of sleeve and, in particular, groove in support tube.

The invention modified with the groove tube, is shown in FIG. 7. The support tube 5 is open, so that the water or other liquid that surround the apparatus has access to the interior of the support tube 5 up to the partition 8, with support tube 5 differing from earlier embodiments by use of at least one groove 42 (additional grooves are easily utilized) lengthwise along tube 5 of aeration element 2. Sleeve 4, as discussed above is an elastic material, especially rubber or a rubber-like polymeric material that stretches around the surface of tube 5. When sleeve 4 is not inflated, hence when aeration is not occurring, sleeve 4 deforms to the curvatures of the surface of tube 5, but the curved joining of the groove 42 and outside surface of tube 5 prevents crease formation in sleeve 4. However, when sleeve 4 is inflated, it expands to a cylindrical form such that groove 42 may not be evident. It has been found, surprisingly, that the invention works best when the inside circumference of sleeve 4 is equal to the outside circumference of the surface of supporting tube 5, whether sleeve 4 is in its inflated or non-inflated state.

Figure 8:
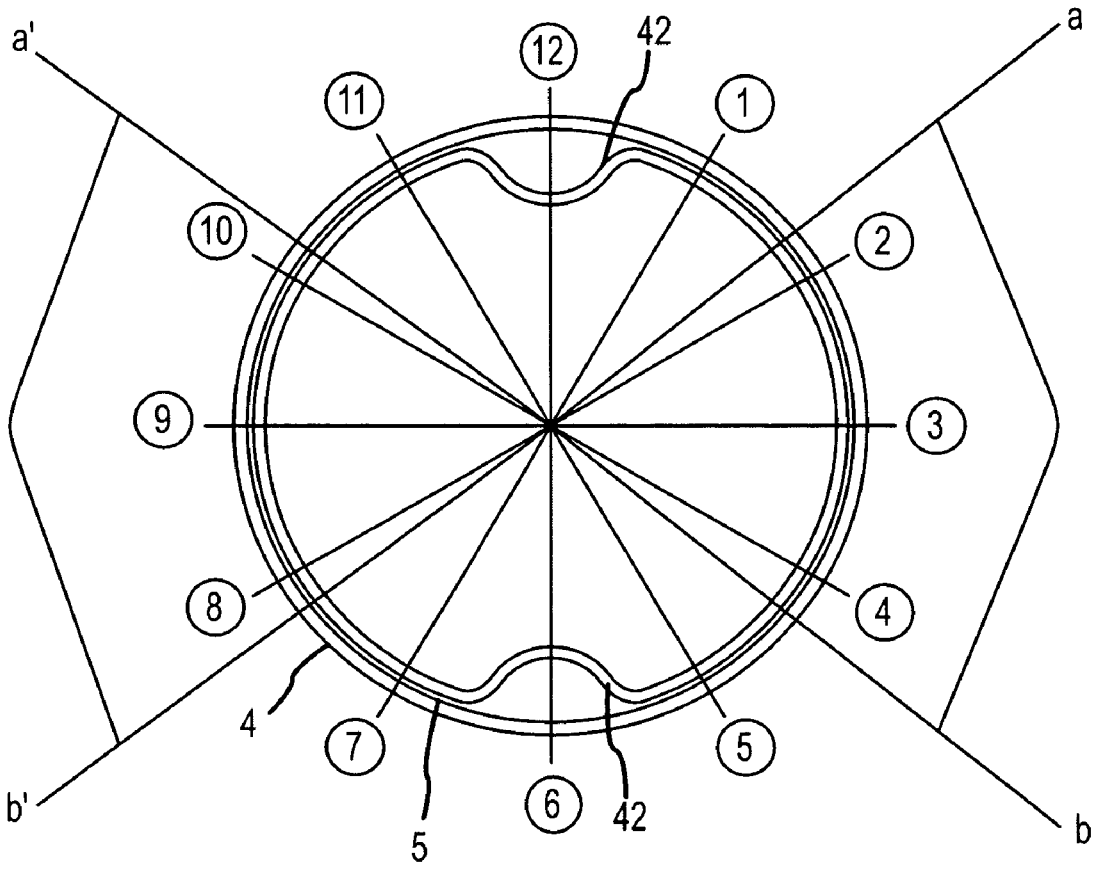
FIG. 8. Is a cross section view of the grooved in support tube with a inflated sleeve.
Figure 9:
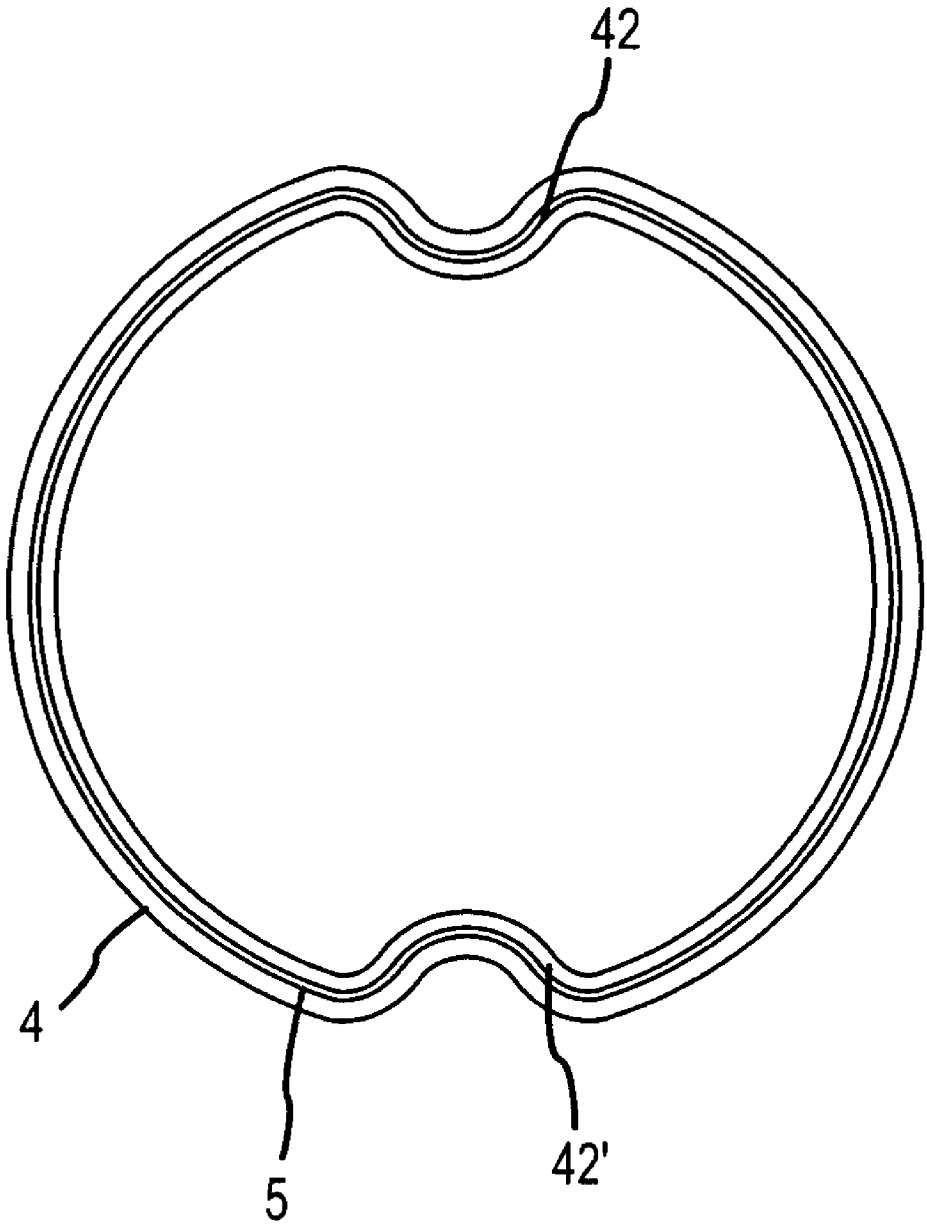
FIG. 9 Is a cross section view of the grooved in support tube with a deflated sleeve showing equal circumference of support tube outside diameter and sleeve inside diameter.

This is further assisted by orientation of the embodiment with two grooves 42, 42' on the aeration element 2, disposed opposite one another lengthwise along tube 5. Utilizing the opposing grooves and specific slit 11 formations in sleeve 4 allows for the maximum utilization of the sleeve without deterioration. Such slit formation, as shown in FIG. 8. As the figure shows, the slits are made within the sleeve 4 in the zone between designations a and b (and the same range directly mirroring such which would encompass 8-10, and marked a' and b') as clearly understood by the hypothetical "clock" numerals 1-12 marked in circles around the perimeter of the sleeve. Surprisingly it was found that this range with the grooves 42, 42' oriented in the "12" and "6" positions was most beneficial to avoid material stress for the sleeve 4. It is preferred that the orientation of the grooves 42, 42' be varied within the 10 and 2 o'clock positions, and the 4 and 8 o'clock positions at most, respectively to avoid sleeve stress. As disclosed in FIG. 9, when not inflated, sleeve 4 conforms to the surface of tube 5 such that it conforms to grooves 42, 42' and has an internal diameter equal to the external diameter or outer diameter of tube 5.

The present invention is, of course, in no way restricted to the specific disclosure of the specification and drawings, but also encompasses any modifications within the scope of the appended claims.

I claim:

1. An apparatus for the gasification or aeration of liquids, comprising:

a distribution conduit that serves for supplying compressed gas;

elongated aeration elements that are connected to said distribution conduit, wherein each aeration element is provided with an essentially rigid support tube about which is disposed a membrane of elastomeric material, and wherein compressed gas is introduced between said support tube and said membrane and can escape via slits in said membrane into a liquid that is to be gasified;

a fitting comprised of a cylindrical portion, wherein said cylindrical portion has a flange of elastomeric material, and a saddle of a semi-rigid plastic; wherein said fitting is disposed between said distribution conduit and a given one of said aeration elements; wherein said fitting is disposed in a bore that passes through a wall of said distribution conduit; and wherein said fitting has an essentially flat saddle portion, one side of said essentially flat saddle portion which rests against an outer surface of said distribution conduit, and another side of said essentially flat saddle portion which rests against an end of said given one of said aeration elements; and a hollow bolt that is securely connected with said given one of said aeration elements wherein said bolt is guided through a bore in said fitting and has a section that is disposed in an interior of said distribution conduit and is provided with apertures that provide communication between said interior of said distribution conduit and the interior of said bolt.

2. An apparatus according to claim 1, wherein in a cross-sectional plane of said distribution conduit two of said bores are provided on a periphery of said conduit at oppositely disposed positions, and wherein two of said aeration elements are aligned with one another by means of said bolt, which extends through respective ones of said bores in said fittings.

3. An apparatus according to claim 1, wherein said end of said aeration element is provided with a threaded bore into which said bolt is threaded.

4. An apparatus according to claim 1, wherein that side of said flat portion of said fitting that rests against said outer surface of said distribution conduit is provided with a curvature that corresponds to said outer surface of said distribution conduit.

5. An apparatus according to claim 1, wherein said bore in said fitting has a diameter that is less than a diameter of said bolt.

6. An apparatus according to claim 3, wherein said threaded connection between said bolt and said aeration element is secured via an interlocking means between contacting surfaces of said aeration element and said fitting.

7. An apparatus according to claim 6, wherein that side of said fitting that rests against said end of said aeration element is provided with at least one wedge-shaped projection that cooperates with recessed areas on said end of said aeration element, wherein said wedge-shaped projections have flatly rising surfaces on which wall portions of said end of said aeration element which wall portions delimit said bolt are threaded together, and wherein said wedge-shaped projections have steeply dropping surfaces against which said wall portions rest when said aeration element and said bolt are unthreaded from one another.

8. An apparatus according to claim 1, wherein at least one ribbed sealing ridge is provided on at least one of said side of said fitting that rests against said end of said aeration element, said side of said fitting that rests against said outer surface of said distribution conduit, and in said bore in said fitting.

9. An apparatus for the gasification or aeration of liquids, comprising:

a distribution conduit that serves for supplying compressed gas;

elongated aeration elements that are connected to said distribution conduit, wherein each aeration element is provided with an essentially rigid support tube having at least one rounded groove within its surface about which support tube is disposed a membrane of elastomeric material, and wherein compressed gas is introduced between said support tube and said membrane and can escape via slits in said membrane into a liquid that is to be gasified;

a fitting comprised of a cylindrical portion, wherein said cylindrical portion has a flange of elastomeric material, and a saddle of a semi-rigid plastic; wherein said fitting is disposed between said distribution conduit and a given one of said aeration elements; wherein said fitting is disposed in a bore that passes through a wall of said distribution conduit; and wherein said fitting has an essentially flat saddle portion, one side of said essentially flat saddle portion which rests against an outer surface of said distribution conduit, and another side of said essentially flat saddle portion which rests against an end of said given one of said aeration elements; and a hollow bolt that is securely connected with said given one of said aeration elements wherein said bolt is guided through a bore in said fitting and has a section that is disposed in an interior of said distribution conduit and is provided with apertures that provide communication between said interior of said distribution conduit and the interior of said bolt.

10. An apparatus according to claim 9, wherein in a cross-sectional plane of said distribution conduit two of said bores are provided on a periphery of said conduit at oppositely disposed positions, and wherein two of said aeration elements are aligned with one another by means of said bolt, which extends through respective ones of said bores in said fittings.

11. An apparatus according to claim 9, wherein said end of said aeration element is provided with a threaded bore into which said bolt is threaded.

12. An apparatus according to claim 9, wherein that side of said flat portion of said fitting that rests against said outer surface of said distribution conduit is provided with a curvature that corresponds to said outer surface of said distribution conduit.

13. An apparatus according to claim 9, wherein said bore in said fitting has a diameter that is less than a diameter of said bolt.

14. An apparatus according to claim 11, wherein said threaded connection between said bolt and said aeration element is secured via an interlocking means between contacting surfaces of said aeration element and said fitting.

15. An apparatus according to claim 14, wherein that side of said fitting that rests against said end of said aeration element is provided with at least one wedge-shaped projection that cooperates with recessed areas on said end of said aeration element, wherein said wedge-shaped projections have flatly rising surfaces on which wall portions of said end of said aeration element which wall portions delimit said bolt are threaded together, and wherein said wedge-shaped projections have steeply dropping surfaces against which said wall portions rest when said aeration element and said bolt are unthreaded from one another.

16. An apparatus according to claim 9, wherein at least one ribbed sealing ridge is provided on at least one of said side of said fitting that rests against said end of said aeration element, said side of said fitting that rests against said outer surface of said distribution conduit, and in said bore in said fitting.

17. An apparatus according to claim 9, wherein two rounded grooves are disposed on said support tube.

18. An apparatus according to claim 17 wherein one of said grooves is disposed in an orientation lengthwise along said support tube between a ten o'clock and a two o'clock position and said other groove is disposed in an orientation lengthwise along said support tube between a four o'clock and an eight o'clock position.

19. An apparatus according to claim 18, wherein one of said grooves is disposed in a twelve o'clock position lengthwise along said support tube and wherein said other of said grooves is disposed in a six o'clock orientation lengthwise along said support tube.

20. An apparatus according to claim 17 additionally comprising a slit pattern along said sleeve wherein said slits are formed only in a region extending slightly beyond between a two o'clock and a four o'clock position and between an eight o'clock and a ten o'clock position along the length of said sleeve.

21. An apparatus according to claim 9 wherein said a circumference of said essentially rigid support tube having at least one rounded groove within its surface is equal to a circumference of said membrane of elastomeric material disposed around said support tube.

22. An apparatus according to claim 1 wherein said membrane of elastomeric material has an inside circumference equal to the outside circumference of said support tube.

* * * * *